United States Patent [19]

Kindig

[11] 4,190,252

[45] Feb. 26, 1980

[54] MULTIPLE DROP TARGET ASSEMBLY FOR AMUSEMENT GAME

[75] Inventor: Cleon V. Kindig, San Jose, Calif.

[73] Assignee: Atari, Inc., Sunnyvale, Calif.

[21] Appl. No.: 870,277

[22] Filed: Jan. 18, 1978

[51] Int. Cl.[2] ..... A63F 7/00

[52] U.S. Cl. ..... 273/127 R

[58] Field of Search ..... 273/127 R, 102 R, 102 AP, 273/102 S, 102.1 R, 102.1 C, 102.1 E, 41, 45

[56] References Cited

U.S. PATENT DOCUMENTS

| | | | |
|---|---|---|---|
| 240,334 | 4/1881 | Pittman | 273/127 R |
| 294,590 | 3/1884 | Crandall | 273/127 R |
| 343,088 | 6/1886 | Stiker | 273/127 R |
| 923,830 | 6/1909 | Grounds | 273/127 R |
| 1,325,921 | 12/1919 | Amlie | 273/127 R |
| 1,534,522 | 4/1925 | Halliday | 273/127 R |
| 2,095,513 | 10/1937 | Reznick | 273/45 |
| 2,126,082 | 8/1938 | Bailey | 273/45 |

*Primary Examiner*—Richard C. Pinkham
*Assistant Examiner*—T. Brown
*Attorney, Agent, or Firm*—Townsend and Townsend

[57] ABSTRACT

A multiple drop target assembly used in an amusement game having a playfield over which balls are moved. A frame mounted below the playfield carries a plurality of targets in side-by-side relationship, with the target heads projecting upwardly through apertures in the playfield. A torsionally rigid reset bar is operated to pivot control arms which in turn are coupled with the targets which are elevated to raised positions where they are releasably latched. When the heads are struck by balls, the targets are unlatched and moved downwardly to lowered positions by spring action. The operating arms of control switches project through apertures formed in the targets so that vertical movement of individual targets actuates the associated switch. The assembly is comprised of modular components for low cost manufacture and to facilitate installation, maintenance and repair.

12 Claims, 4 Drawing Figures

MULTIPLE DROP TARGET ASSEMBLY FOR AMUSEMENT GAME

BACKGROUND OF THE INVENTION

This invention in general relates to amusement games and in particular relates to pinball games of the type employing drop targets.

Certain types of pinball games incorporate a playfield in which drop targets are mounted. In a typical game of this character a number of targets are mounted in side-by-side relationship with the target heads projecting above the playfield. Balls are projected by a player toward the targets, and when a target is struck it is retracted downwardly below the playfield while simultaneously operating a switch or switches in a circuit to indicate a hit. The targets are then reset by a mechanism, usually operated by a solenoid.

There are a number of disadvantages and limitations to existing drop target mechanisms of the type described. One problem is that where a relatively large number of drop targets are simultaneously operated by a single reset mechanism then the mechanism may malfunction so that all targets are not completely reset. A further limitation is that existing drop target mechanisms employ a large number of components in a relatively complicated assembly with the result that they are relatively expensive to manufacture, install, maintain and repair. Additionally, adjustment of the target height is conventionally made by a set screw arrangement which adds to the manufacturing costs and which requires considerable time for one to make the adjustment.

OBJECTS AND SUMMARY OF THE INVENTION

It is a general object of the invention to provide a new and improved drop target assembly for an amusement game of the pinball type.

Another object is to provide a drop target assembly of relatively simple design incorporating a few number of parts in an assembly which is relatively inexpensive to manufacture.

Another object is to provide a drop target assembly of the type described incorporating modular components which facilitates installation, maintenance and repair.

Another object is to provide a drop target assembly of the type described incorporating a target reset mechanism which is capable of uniformly elevating targets to their latched positions in a manner which ensures that all targets are reset.

Another object is to provide a drop target assembly of the type described which facilitates simple and rapid target height adjustment by means of structure which is relatively inexpensive to manufacture.

The invention in summary includes a frame which is mounted below the playfield of a pinball game. Targets are mounted in side-by-side relationship on the frame with the target heads aligned with apertures formed in the playfield of the game. A torsionally rigid reset bar is mounted on a pivot shaft extending transversely of the targets and control arms are mounted between the shaft and the lower ends of the targets. Means is provided to pivot the reset bar for moving the control arms and thereby the targets to raised positions. Spring means is provided for holding the targets latched as well as for urging the targets downwardly when released from the latch upon being struck by a ball. Movement of an individual target operates the arm of a switch in a control circuit for indicating a hit. Bendable tabs are provided for purposes of adjusting the height of the targets.

DESCRIPTION OF THE PREFERRED EMBODIMENT

Figure 1:
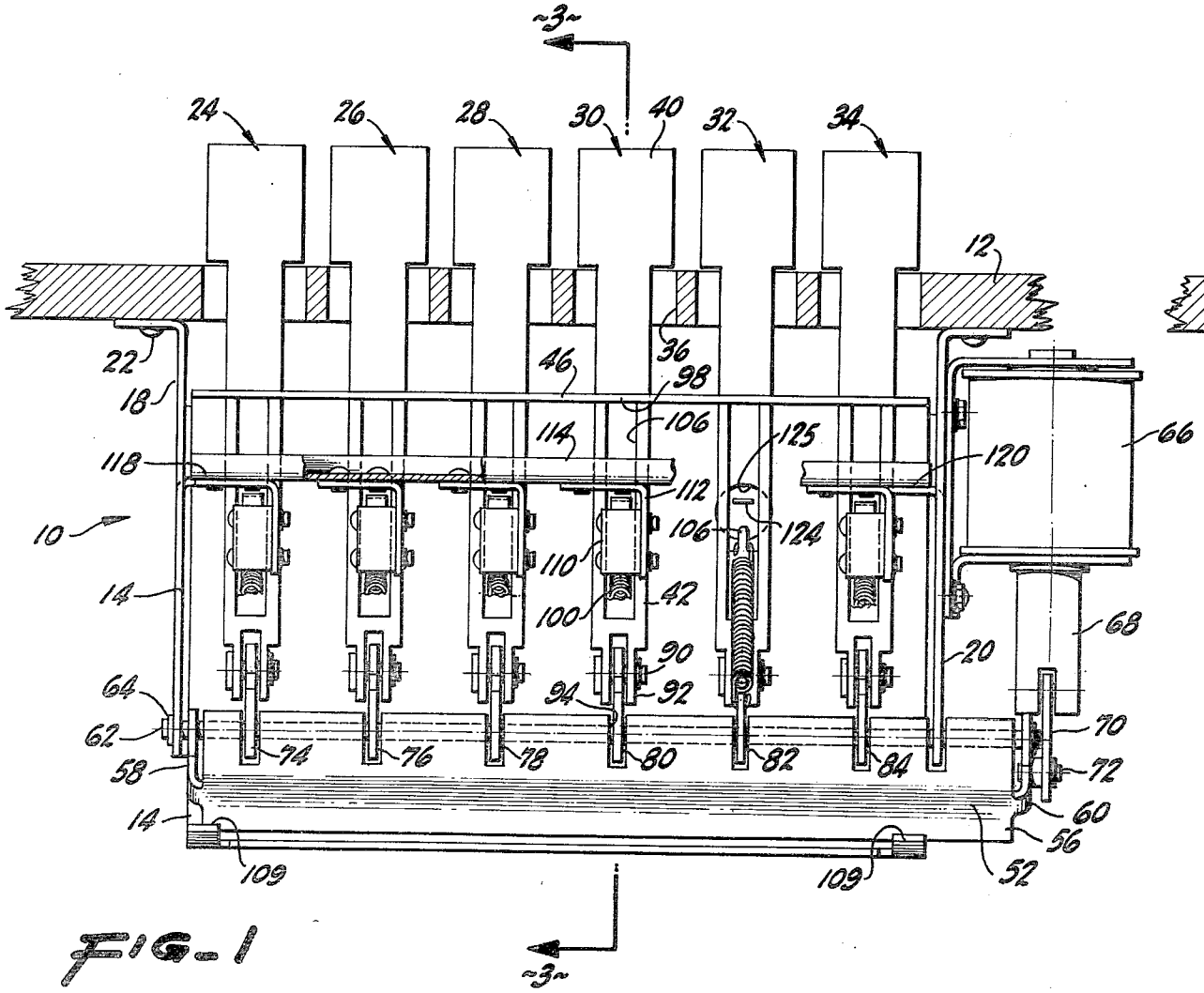
FIG. 1 is a front elevational view of a drop target assembly in accordance with the invention.

In the drawings FIG. 1 illustrates generally at 10 a drop target assembly of the invention as employed in a pinball game having a playfield 12. The game can include other game components such as a ball shooter, rollover switches and bumper switches, indicator lights, and suitable score-keeping displays, not shown. The playfield is mounted in a frame or cabinet which also carries components of a suitable game control circuit.

Drop target assembly 10 includes a frame 14 mounted by bolts 16 to a pair of end brackets 18, 20 which in turn are mounted by fasteners 22 below the playfield. Frame 14 carries a plurality of upstanding targets 24–34 in side-by-side relationship in register with a series of apertures 36 formed in the playfield. The upper or head ends 38 of the targets are formed with an enlarged rectangular shape which, with the targets in the raised position shown in FIGS. 1 through 3, projects above the playfield surface. Suitable graphics, such as a bulls-eye figure, can be formed on the target faces 40. The lower or base ends 42 of the targets are elongate and project downwardly through openings 44 provided in a horizontal ledge 46 formed along the upper margin of frame 14.

Drop target assembly 10 is comprised of modular components which include a target reset assembly 48 and a microswitch bank 50. The reset assembly and microswitch bank are adapted to be separately assembled and then installed as units in the drop target assembly.

Target reset assembly 48 includes a lifting or reset bar 52 having a cross-section which is shaped to provide substantial torsional rigidity, that is a cross-sectional shape having a relatively large moment of inertia of area about the longitudinal center axis. In the illustrated embodiment of the reset bar is formed of an elongate plate of sheet metal with oposite side margins 54, 56 turned at right angles with respect to the flat midportion. The opposite ends 58, 60 of the reset bar are turned upwardly at right angles to the plane of the midportion. The reset bar is carried in the assembly by means of a pivot shaft 62 which extends along a horizontal axis parallel with the line of targets. Opposite ends of the shaft project through openings formed in end brackets 18, 20 as well as through openings formed in the ends 58, 60 of the reset bar. Lock rings 64 are mounted on the shaft ends to hold the parts in assembled relationship.

Figure 3:
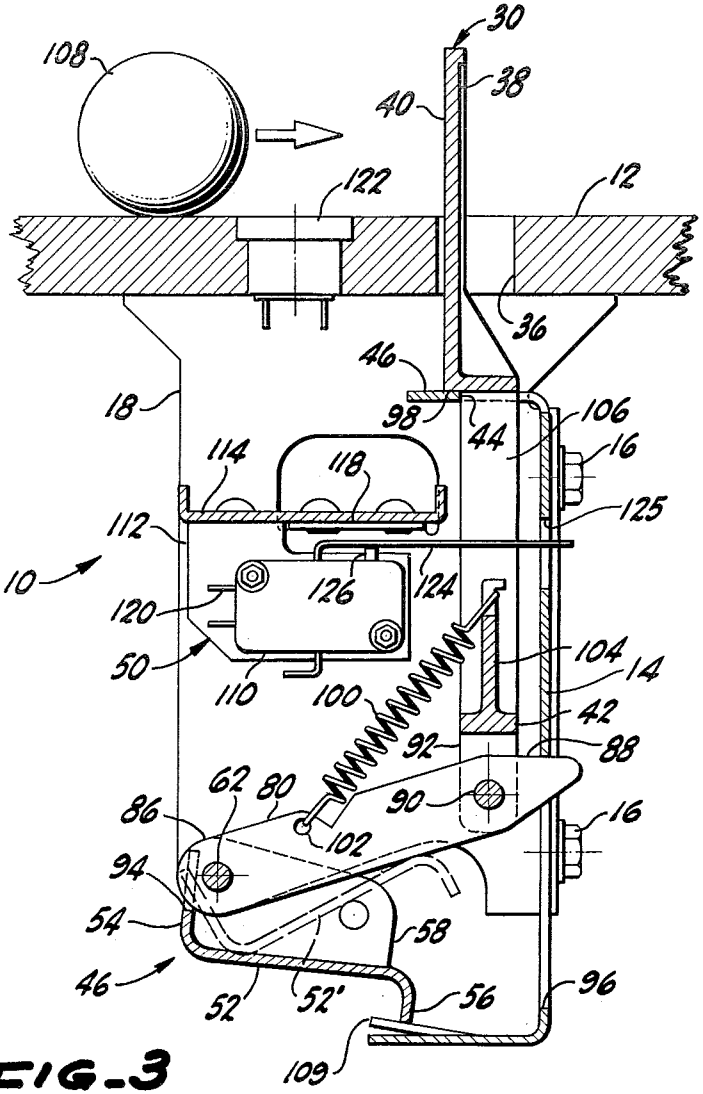
FIG. 3 is a cross-sectional view taken along the line 3—3 of FIG. 1 showing a target in its raised position.

Means is provided for applying a force to one end of the reset bar to produce a moment which pivots the bar from the retracted position shown in solid line at 52 in FIG. 3 to the reset position shown in broken line at 52'.

The means for applying the force includes a solenoid 66 mounted on the outside of bracket 20. An end of solenoid plunger 68 is coupled by a link 70 to end portion 60 of the reset bar by a pivot connection 72 so that when the solenoid is energized to retract the plunger the link pivots the reset bar upwardly. Another solenoid could be connected to the opposite end of the reset bar, particularly where a large number of targets are to be simultaneously reset.

Reset assembly 46 further includes a plurality of control arms 74–84 which conjointly move the targets upwardly when the bar 52 is moved to its reset position. The control arms are pivotally mounted at their proximal ends 86 on pivot shaft 62 and are also pivotally mounted at their distal ends 88 to the targets by pins 90 which are mounted through a clevis 92 formed at the base of each target.

A plurality of guide slots 94 are formed at spaced positions along side margin 54 of the reset bar and the proximal ends of the control arms project through respective slots so that the arms are located at the desired spaced-apart relationship along the pivot shaft. A plurality of vertically elongate guide slots 96 are formed along the lower portion of frame 14 and distal ends 88 of the control arms project through respective slots 96 so that these ends and the target bases which they carry are similarly located at the desired spaced-apart relationship. The guide slot arrangement and the mounting of the control arms and reset bar on the common pivot shaft thereby provide for assembly of the parts in proper position without the requirement for separate fasteners and the like at the points of interconnection.

Figure 4:
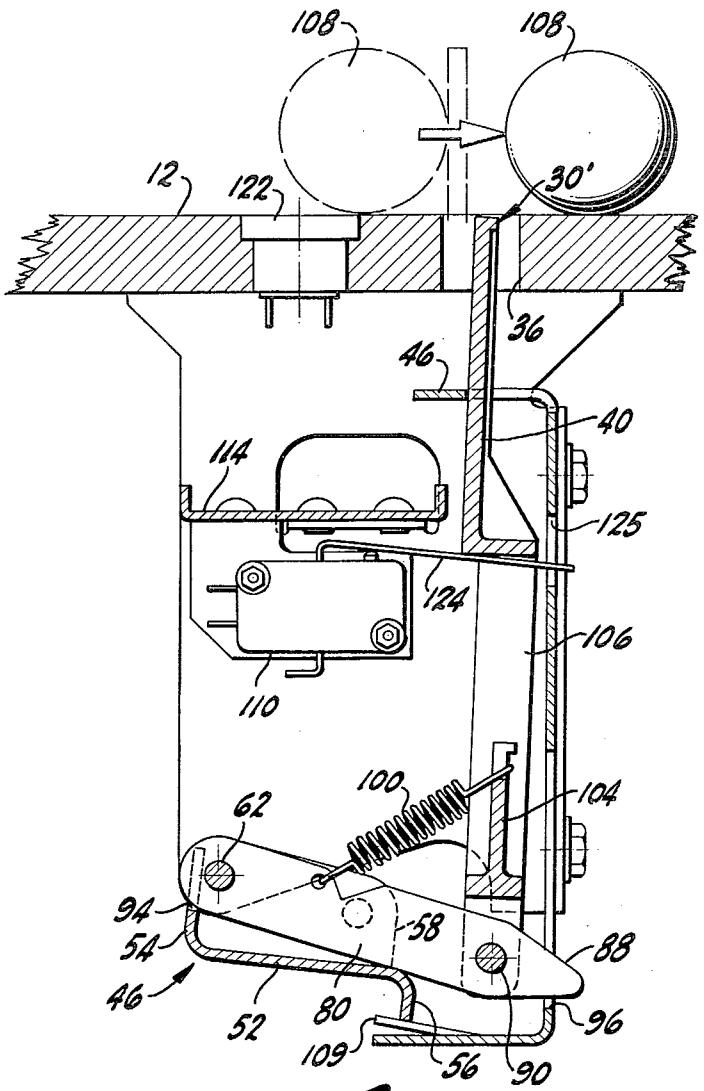
FIG. 4 is a view similar to FIG. 3 showing the target in its lowered position.

Latching means is provided for releasably latching the individual targets in the raised positions. The latching means includes shoulders 98 formed in the targets below the target heads. The shoulders project forwardly and are adapted to move over and rest on the horizontal ledge 46 defined by the top margin of the frame behind which opening 44 is formed. The targets are yieldably held in their latched positions by tension springs 100. The lower end of each tension spring is attached to its associated control arm through opening 102 while the upper end of the spring is hooked over a web 104 which extends upwardly within a vertical slot 106 formed in the target base. The control arms and targets are oriented so that their long axes define an obtuse angle when in the target raised position of FIG. 3, and which define an acute angle when in the target lowered position of FIG. 4. In the target raised position the tension force of the spring urges the target and its control arm to pivot together about pin 90 thereby urging the latching shoulder against ledge 46. When a pinball 108 strikes target head 38, the latching shoulder is dislodged or unlatched from the ledge so that it is free to drop through opening 44. The continued spring tension causes the target and its control arm to undergo a scissors action to rapidly drop the target down with gravity assist. During the downward travel the target builds up speed until the distal end 88 of the control arm strikes the reset bar to generate a sharp sound. The sound which is generated is desirable as an audible signal that the target has been hit.

Means is provided for adjusting the vertical height of the targets in their lowered positions so that all target heads are level with the playfield surface. The adjusting means includes a pair of bendable tabs 109 formed by cutting slots in opposite ends of the lower, forwardly-turned margin of frame 14. When in the retracted position the reset bar rests on and is oriented about its pivot axis by the tab edges. Because the control arms rest on the reset bar when the targets are lowered, the target height is thereby controlled by the tab position. The tabs can be easily and rapidly bent up or down by a suitable tool to make the adjustment. This adjusting arrangement is relatively inexpensive and does not require set screws or other separate parts in the assembly.

Microswitch bank 50 includes a plurality of microswitches 110 mounted by brackets 112 to a plate 114 which in turn is mounted on inwardly turned punched out portions 116, 118 of the end brackets. Each microswitch includes terminals 120 which are connected through suitable leads, not shown, with the control circuit which in turn operates a plurality of pilot lights 122 mounted in the playfield in front of the targets. The switches also include flexible operating arms 124 which extend rearwardly through the slots 106 of respective targets. The tips of the switch arms project through openings 125 formed in frame 14 in alignment with respective switches. The tips are thereby exposed for manual operation such as for test purposes.

It is a feature of the invention that the switch mounting arrangement does not require fasteners or the like for connecting the switch arms with the targets. The operating arms are in contact with control buttons 126 which actuate the switches. The microswitch operating arms are positioned at a preset vertical heighth so as to contact with and be moved downwardly by the upper margin of the slots 106 when the targets approach their lowered positions 30'. Downward movement of the operating arms actuates the microswitches and the control circuit responds to illuminate the pilot light associated with the target which is dropped as well as to advance the score display.

Figure 2:
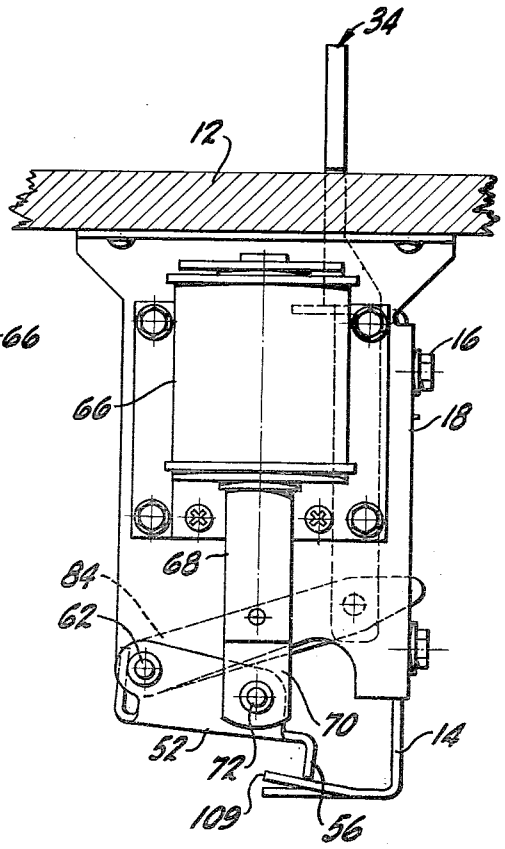
FIG. 2 is a side elevational view of the assembly of FIG. 1.

The use and operation of the invention is as follows. Assuming that all targets are initially in the raised positions as shown in FIGS. 1 through 3, the pinballs 108 are projected by the player along the playfield toward the targets. When a ball strikes a target head the latching shoulder of that target is dislodged from ledge 46. The tension force of spring 100 together with gravity drops the target downwardly to the lowered position of FIG. 4 with the target slot 106 contacting operating arm 124 to actuate microswitch 110. Remaining targets are dropped in a similar manner. For resetting the target solenoid 66 is actuated to retract plunger 68 and pivot reset bar 52 upwardly so that the bar side margin 56 makes contact with and pivots upwardly each of the control arms. The torsional rigidity of the reset bar moves all of the control arms through uniform arcs so that all of the targets which the arms carry are moved upwardly through uniform distances. When the latching shoulders of the targets move upwardly to clear the ledge, the force of the springs pivot the targets forwardly to hold the shoulders on the ledge. The target heads thereby are reset above the playfield for subsequent play. The solenoid is then deactivated so that the reset bar returns by gravity to its retracted position permitting the targets to again drop as they are hit by balls.

While the foregoing embodiment is at present considered to be preferred it is understood that numerous variations and modifications may be made therein by those skilled in the art and it is intended to cover in the appended claims all such variations and modifications as fall within the true spirit and scope of the invention.

What is claimed is:

1. A mechanism for resetting a plurality of ball actuated drop targets positioned for movement relative to the ball rolling playing surface of a pin-ball game apparatus, each of said targets extending through a slot in said playing surface for substantially vertical reciprocation therein and positioned for actuation by a ball rolling on said playing surface, said playing surface further including an exposed lower surface, said mechanism further including the combination of a frame having means for mounting the same on said lower surface, an elongated reset bar, means coupled with said reset bar for mounting the same on the frame in spaced relationship to and below said lower surface for pivotal movement about an axis extending transversely of the direction of movement of the targets, said reset bar having a cross-sectional shape providing substantial torsional rigidity, means for applying a force to one end of the reset bar to produce a movement about its longitudinal axis for pivoting said reset bar in one direction to a target reset position, means coupling said reset bar to the targets for raising the targets to said reset position as a function of the pivotal movement of the reset bar in said one direction, and latch means for releasably holding the targets in raised positions after the reset bar has reached said reset position.

2. A mechanism as set forth in claim 1, wherein the raising means comprises a plurality of control arms, each control arm having a distal end mounted for movement between raised and lowered positions, said distal end of each arm being attached to a respective target, said reset bar being in engagement with the control arms for moving the distal ends of the control arms towards their raised positions.

3. A mechanism as set forth in claim 1, wherein said latch means is operable to release the targets when the latter are struck by a ball moving over said playing surface, and means for yieldably urging the targets toward their lowered positions, whereby the targets move downwardly when released by the latch means.

4. A modular drop target assembly used in an amusement game apparatus having means defining a slotted playfield over which balls are moved, comprising the combination of a frame, means for mounting the frame on and below the playfield, a plurality of elongated, generally upright targets, means shiftably mounting the targets on the frame for up and down movement relative thereto with the targets being mounted in side-by-side relationship on the frame and movable into raised reset and lowered retracted positions in which each target extends through a slot in said playfield, an elongated reset bar mounted on the frame for pivotal movement relative thereto about an axis extending transversely of the direction of movement of the targets, means adjacent to the frame for pivoting the reset bar about the axis in one direction from a retracted position to a raised reset position, control arm means coupled to the reset bar and the targets for elevating the targets toward and into their raised reset position as a function of the pivotal movement of the reset bar in said one direction, means for releasably latching the targets in the raised reset positions thereof, and means for yieldably urging each target downwardly from its raised reset position when the upper part of the target is struck by a ball moving over the playfield.

5. A drop target assembly as set forth in claim 4, wherein the control arm means includes a plurality of control arms with each control arm being pivotally mounted at one end thereof for rotation about said axis and being connected at its opposite end with a respective target, said control arms being mounted in the path of pivotal movement of the reset bar, whereby the reset bar pivots the control arms upwardly as the reset bar moves in said one direction.

6. A modular drop target assembly used in an amusement game having a playfield over which balls are moved, comprising the combination of a frame for mounting, below target apertures formed in the playfield, a plurality of upright targets in side-by-side relationship on the frame for movement between restricted and reset positions, each target having a lower base and an upper head, an elongated reset bar, a pivot shaft, said reset bar being mounted on said pivot shaft for pivotal movement relative to the frame, guide slots formed in the reset bar adjacent to the pivot shaft, said reset bar having a cross-sectional shape providing substantial torsional rigidity, means for pivoting the reset bar about the longitudinal axis from a retracted position to a reset position, a plurality of control arms, there being a control arm for each target, respectively, one end of each control arm being mounted on said pivot shaft for pivotal movement relative to the frame, the opposite end of each control arm being pivotally coupled with the base of a respective target, said one end of each control arm projecting into a respective guide slot of the reset bar so that the guide slots position the control arms in spaced relationship along the pivot shaft, said control arms being mounted to contact said reset bar upon in register with the path of pivotal movement thereof upon downward pivotal movement thereby to said retracted position of said reset bar, whereby the reset bar pivots the control arms upwardly to move the targets upwardly within the target apertures, means for releasably latching the targets in the raised positions with the heads of the targets projecting through the apertures, and means for yieldably urging the targets downwardly from their raised positions so that the targets are released when the target heads are struck by balls moving over the playfield.

7. A drop target assembly as set forth in claim 6, wherein a plurality of vertically extending, horizontally spaced guide slots are formed in the frame adjacent to the targets with the opposite ends of the control arms projecting into respective guide slots for holding the control arms and thereby the targets in spaced apart positions with respect to each other.

8. A modular drop target assembly used in an amusement game apparatus having a playfield over which balls are moved, comprising the combination of a frame for mounting, below target apertures formed in the playfield, a plurality of elongated, upright targets in side-by-side relationship mounted on the frame for movement between retracted and raised reset positions, each target having a lower base and an upper head, an elongated reset bar mounted for pivotal movement about an axis extending transversely of the targets, said reset bar having a cross-sectional shape providing substantial torsional rigidity, means for pivoting the reset bar about said axis to a retracted position from a raised reset position, a plurality of control arms, there being a control arm for each target, respectively, one end of each control arm being mounted for pivotal movement relative to the frame, the opposite end of each control arm being pivotally connected with the base of a respective target, the longitudinal axis of each target and its control arm forming an obtuse included angle when the target is in said raised reset position, said control arms being mounted to contact said reset bar upon downward pivotal movement thereof to said retracted position of reset bar, whereby the reset bar pivots the control arms upwardly to move the targets upwardly, means for releasably latching each target in said raised reset position with the head of each target projecting through an aperture and above the playfield, and spring means connected between each control arm and a respective target for yieldably urging the control arm and the target to pivot toward each other about their interconnection, whereby the targets are caused to move downwardly when the target is released from its latched condition after being struck by a ball rolling on said playfield.

9. A drop target assembly as set forth in claim 8, wherein said latching means includes a horizontal ledge carried by the frame, and means forming a latching shoulder on each target, respectively, with each shoulder being urged by the yieldable means in latching relationship to the ledge when the target is in its raised reset position, whereby when a ball strikes the target head, the shoulder is moved off the ledge and out of latched relationship with respect thereto.

10. A modular drop target assembly used in an amusement game apparatus having a playfield over which balls are moved, comprising the combination of a frame mounted below target apertures formed in the playfield, a plurality of upright targets in side-by-side relationship on the frame for movement between retracted and raised reset positions, each target having a lower base and an upper head, an elongated reset bar mounted for pivotal movement about an axis extending transversely of the target, said reset bar having a cross-sectional shape providing substantial torsional rigidity, means for pivoting the reset bar about said axis from a retracted position from a raised reset position, control arm means actuated by movement of the reset bar for elevating the targets toward raised positions, means for releasably latching the targets in said raised reset position with the heads projecting through the apertures above the playfield, means for yieldably urging individual targets downwardly from said raised positions when the target heads are struck by balls moving over the playfield to release the latching means, means providing a signal when an individual target has been hit, said means including an electrical switch associated with each target, each switch having an operating arm, an aperture formed in each target, said operating arm of each switch projecting through an aperture of a respective target, whereby vertical movement of the target causes upper and lower margins of the aperture to move said operating arm for actuating the switch to thereby activate said signal means.

11. A modular drop target used in an amusement game apparatus having a playfield over which balls are moved, comprising the combination of a frame mounted, below target apertures formed in the playfield, a plurality of upright targets mounted in side-by-side relationship on the frame for movement between retracted and raised reset positions, each target having a lower base and an upper head, an elongated reset bar mounted for pivotal movement about an axis extending transversely of said targets, said reset bar having a cross-sectional shape providing substantial torsional rigidity, means for pivoting the reset bar about said axis from a retracted position to a raised reset position, control arm means actuated by movement of the reset bar for elevating said targets toward said raised reset position, means for releasably latching said target in said raised reset position such that said heads project through said apertures above said playfield, means yieldably urging individual targets downwardly from said raised reset position when said target heads are struck by balls moving over said playfield and releasing said latching means, and means for adjusting the vertical height of said reset bar in its retracted position so that each target head is level with the playfield, said control arm means being carried on said reset bar in its retracted position, whereby the orientation of the reset bar control the position of the control arm means and the vertical height of the targets carried thereby.

12. A drop target assembly as set forth in claim 11, wherein the means for adjusting said reset bar includes bendable tab means formed on the frame below the reset bar for holding the reset bar in a predetermined orientation when it is in its retracted position.

* * * * *